US007712235B2

(12) United States Patent
Sakada et al.

(10) Patent No.: US 7,712,235 B2
(45) Date of Patent: May 11, 2010

(54) LOCK DEVICE OF WORK MACHINE

(75) Inventors: Seiji Sakada, Fukuoka (JP); Yousuke Yamashita, Fukuoka (JP); Kouichi Takata, Fukuoka (JP); Hayato Tsuji, Fukuoka (JP); Syoubu Aramaki, Fukuoka (JP)

(73) Assignee: Yanmar Co., Ltd., Osaka (JP)

( * ) Notice: Subject to any disclaimer, the term of this patent is extended or adjusted under 35 U.S.C. 154(b) by 92 days.

(21) Appl. No.: 11/994,731

(22) PCT Filed: Jan. 20, 2006

(86) PCT No.: PCT/JP2006/300801

§ 371 (c)(1),
(2), (4) Date: May 7, 2008

(87) PCT Pub. No.: WO2007/004333

PCT Pub. Date: Jan. 11, 2007

(65) Prior Publication Data

US 2009/0107015 A1 Apr. 30, 2009

(30) Foreign Application Priority Data

Jul. 5, 2005 (JP) ..... 2005-196869

(51) Int. Cl.
*E02F 3/96* (2006.01)
*B66C 23/00* (2006.01)

(52) U.S. Cl. ..... 37/468; 414/686; 414/687; 414/694; 172/272

(58) Field of Classification Search ..... 37/468; 172/272–275; 414/724, 687, 695.5–695.8, 414/694, 686

See application file for complete search history.

(56) References Cited

U.S. PATENT DOCUMENTS 3,351,357 A * 11/1967 Van Eaton ..... 172/275

(Continued)

FOREIGN PATENT DOCUMENTS

JP 56-32705 3/1981

(Continued)

OTHER PUBLICATIONS

International Search Report mailed on Mar. 14, 2006 for International Application No. PCT/JP2006/300801 filed on Jan. 20, 2006, 2 pgs.

*Primary Examiner*—Thomas A Beach
(74) *Attorney, Agent, or Firm*—Sterne, Kessler, Goldstein & Fox P.L.L.C.

(57) ABSTRACT

A lock device is improved in durability by operating the operation member of a boom lock device in a non-contact state to solve a problem in a conventional work machine because there is a problem that the operation member is worn at the lateral rotating part of a boom bracket. In the lock device 51 for locking a boom 16 of the excavating device to the main body, an engaging member is provided on one of the boom and a boom bracket 15 provided on the main body, and an engaged member is provided on the other of the boom and the boom bracket. The engaging member is constituted by a plate formed on one side thereof with a hook part 52*a*, and on the other side thereof with a slot 52*c*. A support pin 55 is inserted into the slot, and a stopped 53 is disposed above the support pin, so that the support pin 55 and the stopper 53 support the engaging member.

6 Claims, 12 Drawing Sheets

U.S. PATENT DOCUMENTS

| | | | | | |
|---|---|---|---|---|---|
| 3,811,582 | A | * | 5/1974 | Shumaker et al. | 414/694 |
| 3,874,533 | A | * | 4/1975 | Montgomery et al. | 414/723 |
| 3,921,835 | A | * | 11/1975 | Baker et al. | 414/694 |
| 4,225,282 | A | * | 9/1980 | Nordstrom et al. | 414/694 |
| 4,260,321 | A | * | 4/1981 | Beauchamp et al. | 414/694 |
| 4,397,604 | A | * | 8/1983 | McCain | 414/723 |
| 4,720,234 | A | * | 1/1988 | Stralow | 414/686 |
| 4,726,731 | A | * | 2/1988 | Jones | 414/723 |
| 4,871,292 | A | * | 10/1989 | Milanowski | 414/723 |
| 4,887,938 | A | * | 12/1989 | Menke | 414/694 |
| 4,944,649 | A | * | 7/1990 | Stralow | 414/686 |
| 4,986,722 | A | * | 1/1991 | Kaczmarczyk et al. | 414/723 |
| 4,997,333 | A | * | 3/1991 | Ball et al. | 414/694 |
| 5,064,339 | A | * | 11/1991 | Ahlers | 414/687 |
| 5,111,603 | A | * | 5/1992 | Knowlton et al. | 37/231 |
| 5,141,385 | A | * | 8/1992 | Tibbatts et al. | 414/723 |
| 5,779,429 | A | * | 7/1998 | Poole | 414/723 |
| 5,967,737 | A | * | 10/1999 | Kraske et al. | 414/694 |
| 6,168,369 | B1 | * | 1/2001 | Bright et al. | 414/724 |
| 6,648,582 | B2 | * | 11/2003 | Mayer et al. | 414/694 |
| 6,699,001 | B2 | * | 3/2004 | Fatemi | 414/723 |
| 6,996,926 | B2 | * | 2/2006 | Fatemi | 37/468 |
| 7,001,134 | B2 | * | 2/2006 | Aoki et al. | 414/686 |
| 7,198,451 | B2 | * | 4/2007 | Wimmer | 414/723 |
| 7,493,712 | B2 | * | 2/2009 | McCormick et al. | 37/468 |

FOREIGN PATENT DOCUMENTS

| | | |
|---|---|---|
| JP | 56-110159 | 8/1981 |
| JP | 2004-360331 | 12/2004 |

* cited by examiner

LOCK DEVICE OF WORK MACHINE

BACKGROUND OF THE INVENTION

1. Technical Field

The present invention relates to a lock device which prevents a work machine of a construction machine from being tilted by the weight thereof. Especially, the present invention relates to a lock device which prevents a boom of a backhoe work machine from being rotated downward by the weight thereof.

2. Background Art

Conventionally, there is well known a so-called tractor loader backhoe constructed so that a loader is attached to a front portion of a traveling vehicle and a backhoe is attached to the rear portion thereof. With regard to such a kind of a tractor loader backhoe, a side column supporting a boom is standingly provided on a side frame at the front portion of the tractor, a bucket is supported at the tip of the boom, and the boom and the bucket can be rocked respectively by hydraulic cylinders, whereby a front loader is constructed. A boom is supported in the rear portion of the tractor so as to be rotatable vertically and laterally, an arm is supported at the tip of the boom so as to be rotatable vertically, a bucket is supported at the tip of the arm so as to be rotatable vertically, and each of them can be rotated by a hydraulic cylinder, whereby a backhoe is constructed.

The front loader is operated by an operation part arranged at a side of a seat. The backhoe is operated by a lever or the like provided on an operation column standingly provided on a frame of the rear portion while the seat is reversed longitudinally.

The tractor loader backhoe travels by wheels so that the tractor loader backhoe can travel at relatively high speed. At the time of traveling, if the loader or the backhoe which is a work machine is fallen by vibration, leak of pressure oil or the like, the travel may be hindered. Then, there is well known an art for locking the work machine at the time of not operating the work machine (for example, see the Patent Literature 1).

Patent Literature 1: the Japanese Patent Laid Open Gazette 2004-360331

BRIEF SUMMARY OF THE INVENTION

However, with regard to the art of the Patent Literature 1, the movement of the operation lever is restricted, and leak of pressure oil causes fall of the work machine by the weight thereof. Then, there is an art preventing the fall mechanically. For example, a lock member is provided at the rotary basal part of the boom and an operation member is extended from the operation column so as to operate the lock member, thereby locking the boom. However, the operation member always touches the lock member so that friction occurs every time each mechanism is actuated so that the touch part is abraded and rusts, whereby the life of the members is shortened.

Thus, the present invention is intended to provide a lock device comprising an engaging member and an engaged member such that lock operation can be performed manually easily.

The above-mentioned problems are solved by the following means.

According to a first aspect of the present invention, a lock device of a work machine including a main body and an excavating device is provided for locking a boom of the excavating device to the main body. In the lock device, an engaging member is provided on one of the boom and a boom bracket provided on the main body, and an engaged member is provided on the other of the boom and the boom bracket. The engaging member is constituted by a plate formed on one side thereof with a hook part, and on the other side thereof with a slot. A support pin is inserted into the slot, and a guide member is disposed above the support pin, so that the support pin and the guide member support the engaging member. The engaging member is provided on the other side thereof with first and second surfaces so that the first surface is parallel to the slot, and the second surface is slanted from the slot. When the engaged member is released from the hook part, either the first surface or the second surface can touch the guide member. When the engaged member is engaged with the hook part, the second surface touches the guide member.

According to a second aspect of the invention, the guide member is provided on the boom, and does not become horizontal while the boom is rotated between its highest position and its lowest position.

According to a third aspect of the invention, an end surface of the one side of the engaging member at which the hook part is positioned is enabled to touch the engaged member and is slanted toward a lengthwise center of the engaging member.

According to a fourth aspect of the invention, a slip-prevention plate is fixed to a tip of the support pin and the support pin can be inserted into the slot through the slip-prevention plate at a prescribed angle.

According to a fifth aspect of the invention, a member supporting the engaging member is projected from the boom bracket and the guide member is formed integrally with the boom bracket.

According to sixth aspect of the invention, the engaging member is provided with upper and lower guide members such as to slidably touch upper and lower surfaces of the other side of the engaging member.

The present invention constructed as the above brings the following effects.

According to the first aspect of the present invention, the lock device is constructed easily, and by sliding the engaging member along the slot and by touching the guide member with either the first or second surface of the engaging member, the engaging member can be held in the lock position or the lock release position.

According to the second aspect of the present invention, at any rotation position of the boom between the highest position and lowest position, the engaging member maintains the lock position, whereby it is not necessary to provide a holding mechanism for the engaging member so that the lock device is simplified and the cost is reduced.

According to the third aspect of the present invention, at the time that the engaging member moves to the lock side, when the boom is rotated to the lock position, the engaging member can evade by the slanting of the end surface of the one side of the engaging member, thereby preventing the engaging member and the engaged member from being damaged by their touching.

According to the fourth aspect of the present invention, the engaging member is inserted while the support pin is disposed at the predetermined angle, and the engaging member is prevented from slipping off by changing the angle of the support pin. Accordingly, the slip-prevention mechanism is constructed easily and it is not necessary to provide any slip-prevention member separately, whereby the number of parts is reduced, and the number of assembly processes is also reduced.

According to the fifth aspect of the present invention, it is not necessary to provide any guide member separately, whereby part number is reduced. It is not necessary to assemble the guide member, whereby number of assembly processes is reduced so as to reduce the cost.

According to the sixth aspect of the present invention, the engaging member is guided at its upper and lower sides, whereby the guide of the engaging member is stabilized so as to prevent ricketiness. Force applied on the guide member is dispersed into two, whereby the guide member is constructed small and the life of the lock mechanism is prolonged.

DETAILED DESCRIPTION OF THE INVENTION

Figure 1:
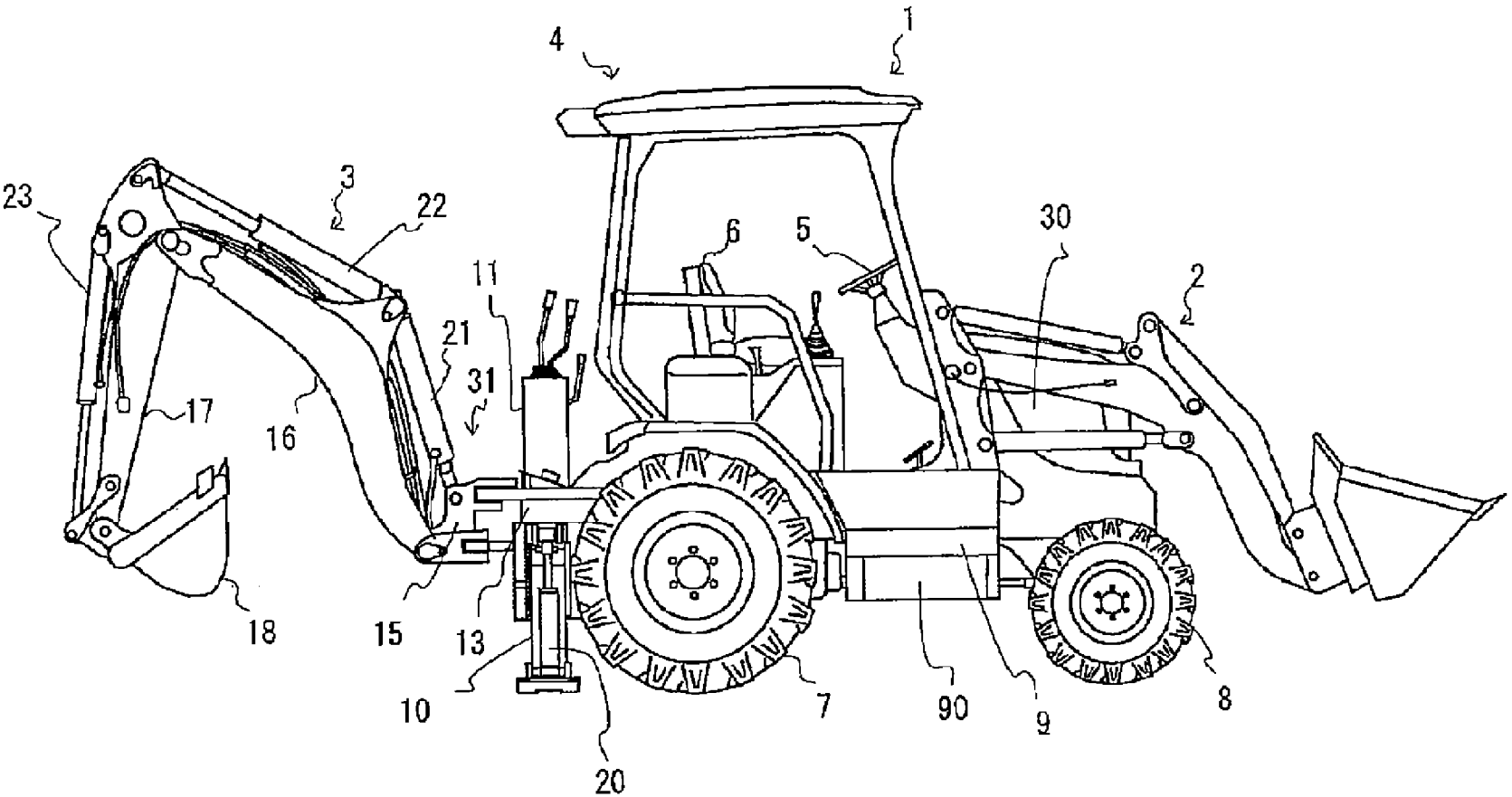
FIG. 1 It is an entire side view of a work vehicle according to the present invention.
Figure 2:
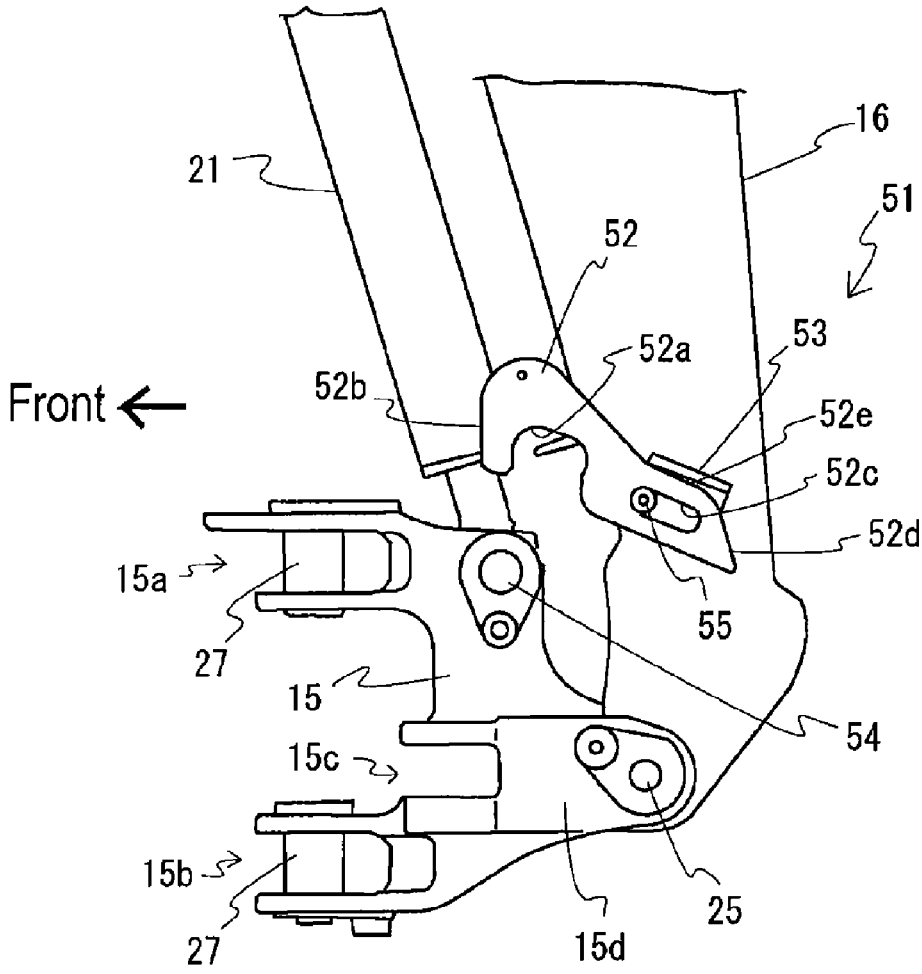
FIG. 2 It is a side view of a lock device according to the present invention.
Figure 3:
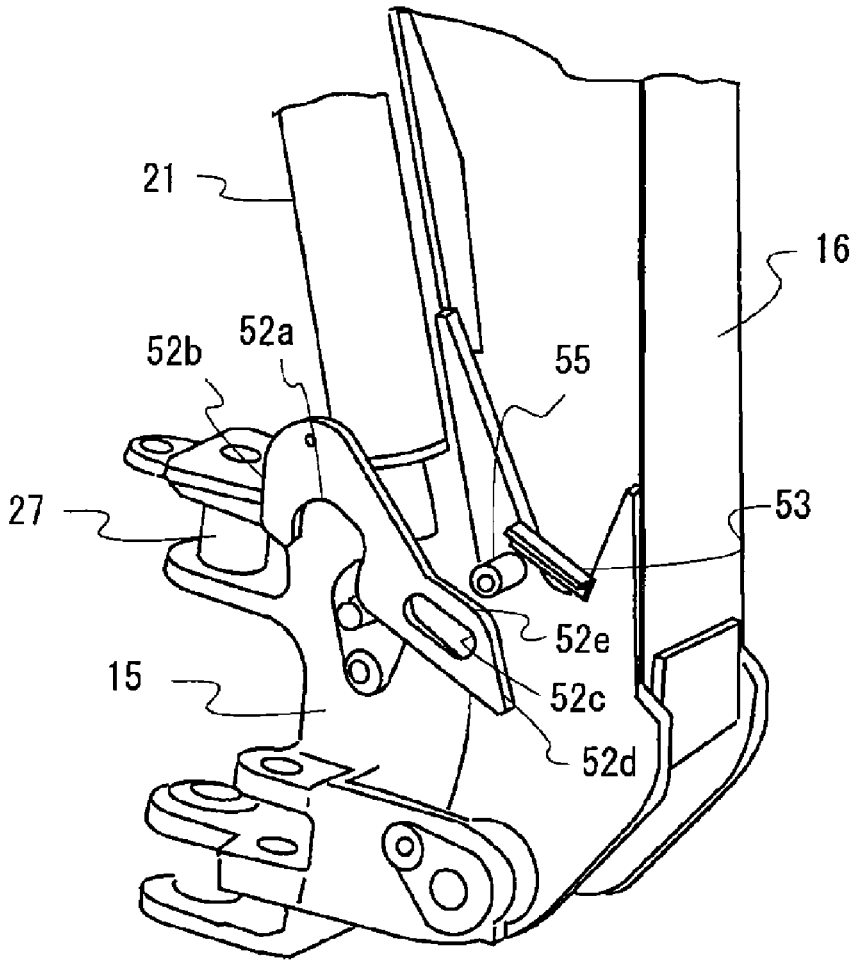
FIG. 3 It is a perspective view of the lock device.
Figure 4:
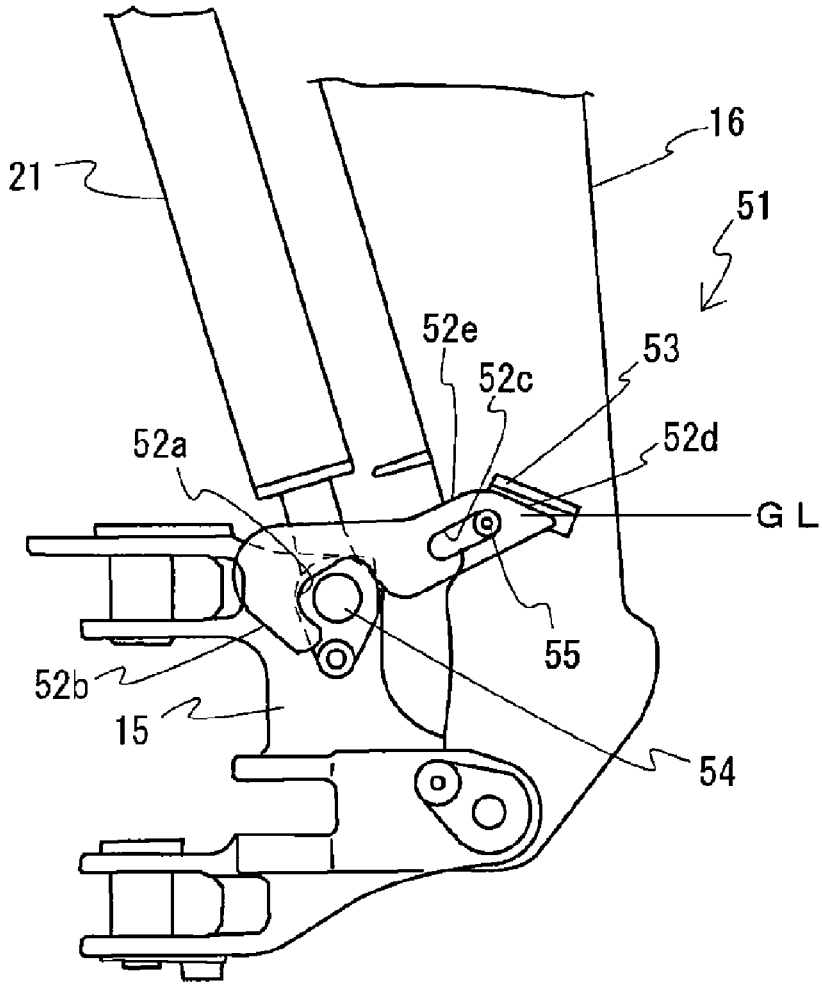
FIG. 4 It is a side view of the lock device in a lock state.
Figure 5:
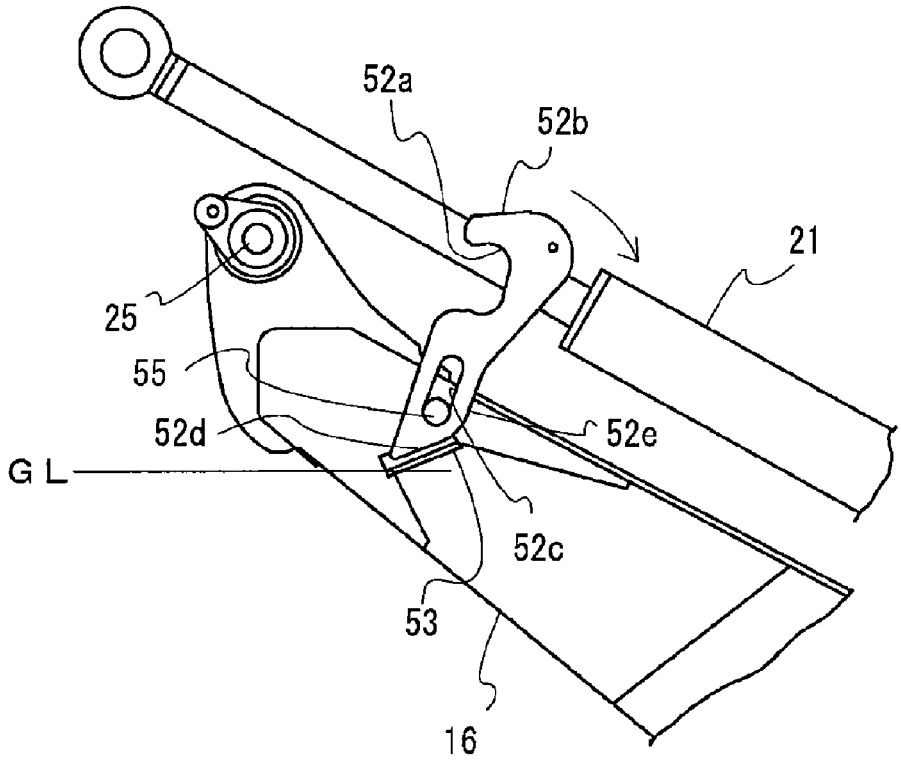
FIG. 5 It is a side view of the lock device in the state that a boom is fallen to the lowest position.
Figure 6:
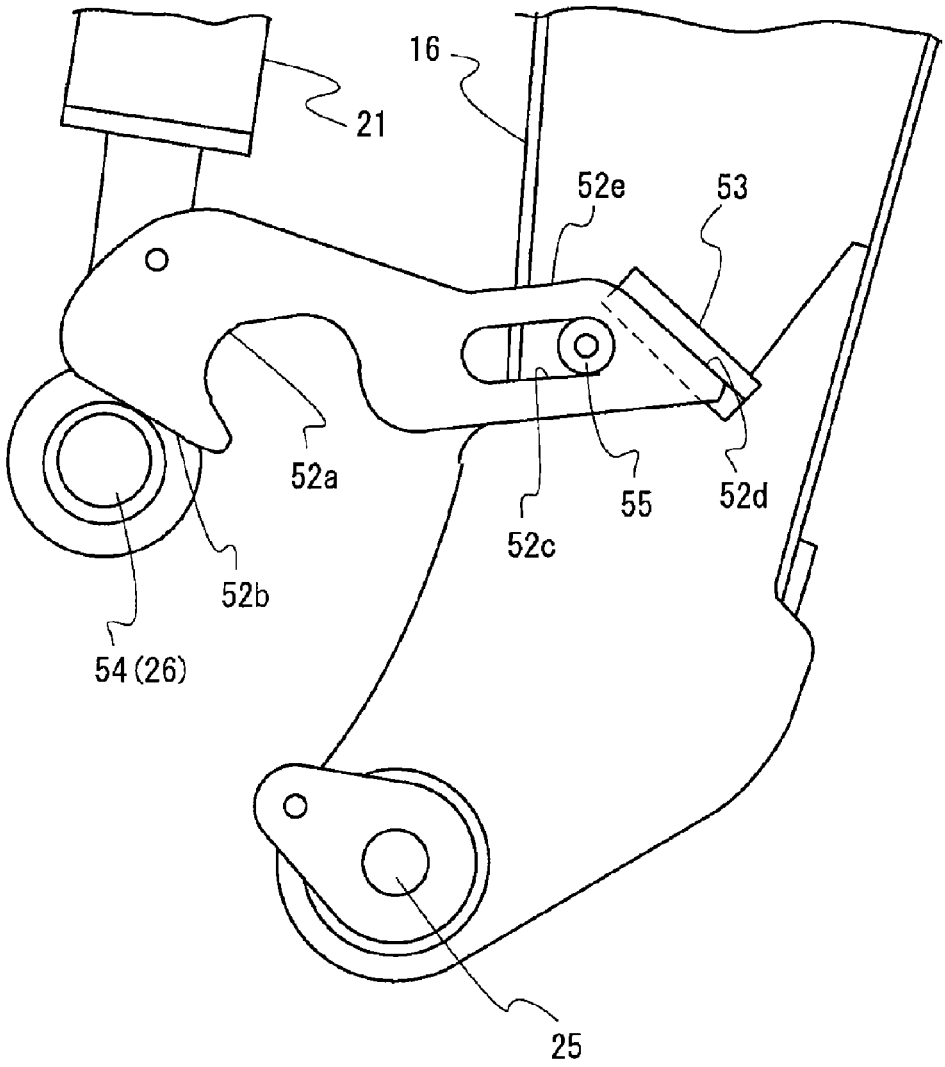
FIG. 6 It is a side view of the lock device in the state that a lock plate is slid to a lock side so as to touch a lock pin.

Next, explanation will be given on the mode for carrying out the present invention. FIG. 1 is an entire side view of a work vehicle according to the present invention. FIG. 2 is a side view of a lock device according to the present invention. FIG. 3 is a perspective view of the lock device. FIG. 4 is a side view of the lock device in the lock state. FIG. 5 is a side view of the lock device in the state that a boom is fallen to the lowest position. FIG. 6 is a side view of the lock device in the state that a lock plate is slid to lock side so as to touch a lock pin.

Firstly, explanation will be given on entire construction. A work vehicle 1 shown in FIG. 1 is a tractor loader backhoe equipped with a loader 2 and an excavating device 3. An operation part 4 is provided at the center of the work vehicle 1. The loader 2 is disposed before the operation part 4, and a backhoe as the excavating device 3 is disposed behind the operation part 4. The work vehicle 1 is equipped with front wheels 8 and rear wheels 7 so that the work vehicle 1 equipped with the loader 2 and the excavating device 3 is enabled to travel.

A steering wheel 5 and a seat 6 are disposed in the operation part 4. A travel operation device and an operation device of the loader 2 are disposed at the side of the seat 6. Accordingly, steering operation of the work vehicle 1 and operation of the loader 2 can be performed at the operation part 4.

The loader 2, i.e., a loading device, is connected to side portions of the work vehicle 1 and is extended forward, and a bucket is equipped on the tip of the loader 2. An engine is disposed in the front portion of a frame 9 which is a chassis of the work vehicle 1, and a bonnet 30 disposed on the frame 9 covers the engine. The loader 2 is disposed outside the bonnet 30.

The work vehicle 1 is detachably equipped on the rear portion thereof with the excavating device 3, and the excavating device 3 is operated with a lever and the like on an operation column 11 disposed behind the seat 6.

A pressure oil tank 90 is disposed at a side portion of the operation part 4, and the pressure oil tank 90 also serves as a step to the operation part 4. A step constructed by a fuel tank is disposed at the opposite side of the operation part 4.

An attachment part for a work machine is provided at the rear end of the frame 9, and a work machine frame 13 of the excavating device 3 is fixed to the attachment part. The operation column 11 is standingly provided at the lateral center of the work machine frame 13, and the operation lever and the like are disposed on the operation column 11. Stabilizers 10 are provided at both left and right sides of the work machine frame 13 and can be rotated vertically by expansion and contraction of hydraulic cylinders 20. A boom bracket 15 is attached to the rear portion of the work machine frame 13 so as to be rotatable laterally centering on the vertical axis and is rotated by a hydraulic cylinder (not shown). A basal part of a boom 16 is pivotally attached to the rear portion of the boom bracket 15 so as to be rotatable vertically centering on the lateral axis and is rotated by a boom cylinder 21. A basal part of an arm 17 is pivotally attached to the tip of the boom 16 so as to be rotatable vertically centering on the lateral axis and is rotated by an arm cylinder 22. A bucket 18 is attached to the tip of the arm 17 through a linkage mechanism so as to be rockable and is rocked by a bucket cylinder 23.

As shown in FIG. 2, the boom bracket 15 is substantially U-like shaped when viewed in side. Support parts 15*a* and 15*b* are respectively formed in the upper front portion and the lower portion of the boom bracket 15. Support holes are respectively formed vertically in the support parts 15*a* and 15*b*. The boom bracket 15 and the work machine frame 13 are pivotally connected to each other through two pivot pins 27 which are lateral-rotation fulcrums so that the boom bracket 15 is laterally rotatably supported at the lateral center of rear portion of the work machine frame 13. Two pivot parts 15*c* are respectively formed in the lower portions of both left and right sides of the boom bracket 15, and support holes are respectively formed vertically in the pivot parts 15*c* so that each of the pivot parts is connected pivotally to a tip of a swing cylinder, whereby the boom bracket 15 is rotated laterally by the swing cylinder. A support part 15*d* is projected rearward from the lower rear portion of the boom bracket 15 and a support hole is bore laterally in the support part 15*d* so as to support pivotally the lower portion of the boom 16 by a pivot pin 25. A support hole is bore laterally in the upper rear portion of the boom bracket 15 so as to pivotally support the lower portion of the boom cylinder 21 by a lock pin 54 also serving as a pivot pin.

Next, explanation will be given on a lock device 51 of the present invention according to FIGS. 2 to 6.

The lock device 51 comprises the lock pin 54 provided in the boom bracket 15 of the vehicle so as to serve as an engaged member, a lock plate 52 serving as an engaging member of the work machine engaging with the lock pin 54, and a guide member 53 keeping the lock plate 52 at a prescribed position.

Explanation will be given according to FIGS. 2 and 3 showing the state that the boom 16 is raised to the highest position (rotated forward).

The lock plate 52 and the guide member 53 are attached to the side surface of the boom 16, and the lock pin 54 is projectively provided on the side surface of the boom bracket 15. In addition, to the contrary, it may alternatively be constructed that the lock pin is attached to the boom and the lock plate is attached to the boom bracket. A hook part 52*a* which is substantially C-like shaped and opened downward is formed at one of sides of the lock plate 52, and a forward-slanted surface 52*b* is formed at the tip (front end) of the lock plate 52. The forward-slanted surface 52*b* is slanted downward to the opened side of longitudinal center of the lock plate 52 when viewed in side.

A slot 52*c* which is elongated longitudinally is opened at the other side (rear side) of the lock plate 52. A support pin 55 is inserted into the slot 52*c* so as to support the lock plate 52 rotatably and slidably. The support pin 55 is projectively provided on the side surface of the boom 16 along the same direction as the lock pin 54.

The lock plate 52 is formed at the rear end thereof with a rearward-slanted surface 52*d*, and is provided with a rear upper surface 52*e* before the rearward-slanted surface 52*d* so as to have an obtuse angle between the rearward-slanted surface 52*d* and the rear upper surface 52*e*. When the support pin 55 is positioned in the rear portion of the slot 52*c*, the lock plate 52 can be rotated vertically between the lock position and the release position, while the angle of the lock plate 52 is regulated by the guide member 53 in cooperation with the rearward-slanted surface 52*d* and the rear upper surface 52*e* due to the substantially trapezoidal shaped rear portion of the lock plate 52. Namely, as shown in FIG. 6, the part where the rear upper surface 52*e* is contiguous to the rearward-slanted surface 52*d* is circular arc-like shaped centering on the axis of the support pin 55 while the lock plate 52 is slid forward. The slot 52*c* is disposed parallel to the rear upper surface 52*e*, and the shortest distance between the axis of the support pin 55 and the rear upper surface 52*e* is the same as that between the axis of the support pin 55 and the rearward-slanted surface 52*d*. In addition, though it is not shown in the drawings of this embodiment, it may alternatively be constructed that one of ends of a link or wire is connected to the part of the lock plate 52 in the vicinity of the hook part 52*a* and the other end of the link or wire is connected to an operation member arranged in the operation part 4, whereby the lock and release operation by the lock plate 52 can be performed by operating (pushing and pulling) the operation member at the operation part 4.

Figure 7:
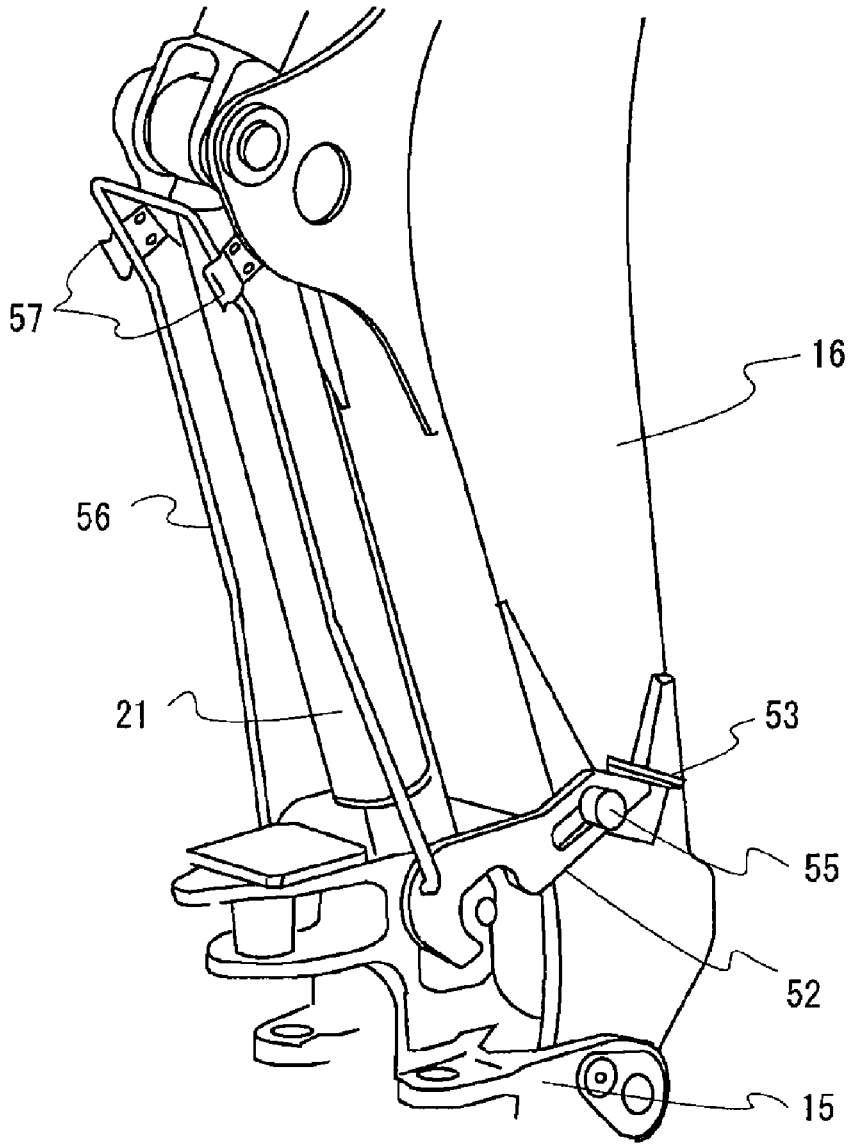
FIG. 7 It is a perspective view of the vicinity of the boom that an operation lever is provided on the lock plate.

As shown in FIG. 7, it may alternatively be constructed that one of end of an operation lever 56 is supported in the vicinity of the hook part 52*a* of the lock plate 52 and the other end of the operation lever 56 is engaged with the front side (back surface) of the boom 16. The operation lever 56 is substantially inverse U-like shaped when viewed in front. The open end of the operation lever 56 is inserted into an engaged hole opened in the hook part 52*a* and is pivotally supported. The other end of the operation lever 56 is extended upward along the boom 16, and two engage fittings 57 constructed by metal leaves or the like are fixed to the front surface of vertical middle portion of the boom 16 so as to be engaged with both left and right sides of the other end of the operation lever 56. Accordingly, when the lock plate 52 is disposed in the lock position or the release position, the other end of the operation lever 56 is engaged with and held by the engage fittings 57, and at the time of operation, the closed side of the operation lever 56 is gripped by a hand and the operation lever 56 is rotated to this side so as to release the engagement, and then the lock or release operation is performed and the operation lever 56 is engaged with the engage fittings 57 again. In addition, though the lock plate 52 is provided at each of the left and right sides in this case, it may alternatively be constructed that the lock plate is provided at one of the left and right sides and operated by one operation lever. The engagement of the operation lever 56 is not limited to the above-mentioned construction.

The guide member 53 is formed by bending a plate L-like shaped when viewed in rear, and is fixed to the side surface of the support pin 55 at the side of basal part of the boom 16 so that the upper surface of the guide member 53 is projected sideward. In other words, as shown in FIG. 2, when the boom 16 is positioned vertically (at the foremost position), the support pin 55 is positioned below the front end of the guide member 53. In addition, the guide member 53 may alternatively be constructed integrally with the boom 16. In the state of FIG. 2, the distance between the support pin 55 and the guide member 53 is slightly longer than the distance between the inner surface of the slot 52*c* and the rear upper surface 52*e* of the lock plate 52 so that the lock plate 52 is attached longitudinally slidably. In the state of FIG. 4, the distance between the support pin 55 and the guide member 53 is slightly longer than the distance between the inner surface of the slot 52*c* and the rearward-slanted surface 52*d* of the lock plate 52. Accordingly, when the lock plate 52 is slid forward to the lock position, the lock pin 54 is engaged therewith and the rear portion of the rearward-slanted surface 52*d* touches the lower surface of the guide member 53 so as to prevent further downward rotation of the lock plate 52.

With regard to the tilt angle of the guide member 53, as shown in FIG. 4, when the boom 16 is rotated the foremost position, i.e., the lock position, and the hook part 52*a* of the lock plate 52 is engaged with the lock pin 54, the rearward-slanted surface 52*d* is parallel to the guide member 53 and touches the guide member 53, whereby the guide member 53 is slanted rearward. As shown in FIG. 5, when the boom 16 is rotated to the lowest position, the angle between the guide member 53 and a horizontal line GL is positive. In other words, the angle of the surface of the guide member 53 touching the lock plate 52 is always positive (in the first or second quadrant).

Accordingly, when the lock plate 52 is in the release state that the rear upper surface 52*e* touches the guide member 53 as shown in FIG. 2, the state can be maintained even if the boom 16 is rotated to any position. Namely, even if the lock plate 52 is projected along the slot toward the bucket 18 by vibration or the like, the rear upper surface 52*e* is fallen along the guide member 53 or the slot 52*c* is fallen along the support pin 55 by the weight thereof so as to return to the original position. Even if the lock plate 52 is locked at the lowest position (projected), the lock plate 52 is rotated rearward by the weight thereof centering on the support pin 55 and slid downward so as to reach the release position automatically.

When the boom 16 is rotated forward so as to be locked at the time of finishing the work, even if the lock plate 52 is at the lock position (projected) by vibration or the like as shown in FIG. 6, the forward-slanted surface 52*b* touches the lock pin 54 so that the lock plate 52 is lifted and rotated upward centering on the support pin 55, thereby prevented from being stretched against the guide member 53 and damaged. When the boom 16 is rotated to the foremost position while the lock plate 52 is projected, the lock pin 54 moved from the forward-slanted surface 52*b* reaches the hook part 52*a* of the lock plate 52 so that the lock plate 52 is engaged with the lock pin 54 so as to be locked.

The lock pin 54 is projectively provided from the side surface of upper rear portion of the boom bracket 15 and can be engaged with the lock plate 52. In this embodiment, the lock pin 54 is arranged at the lower end of the boom cylinder 21, that is, at a side of a fulcrum pin 26 pivotally supporting the tip of the rod. In addition, the lock pin 54 may alternatively be constructed integrally with the fulcrum pin 26 or constructed to also serve as the fulcrum pin 26.

With regard to the above-mentioned construction, at the time of work of the excavating device 3, the lock plate 52 is disposed at the release position where the rear upper surface 52*e* touches the lower surface of the guide member 53 and the support pin 55 is positioned in the slot 52*c* at the side of the center of the lock plate. When the vehicle travels after finishing the excavation work of the excavating device 3, when the loader work is performed, or when the machine is to be stored, the boom cylinder 21 is contracted so as to rotate the boom 16 to the foremost position (toward the operation part 4). In this state, the lock plate 52 is pulled forward and rotated downward about the rear portion of the slot 52*c* as a fulcrum so as to engage the hook part 52*a* with the lock pin 54, whereby the boom is locked. Accordingly, the boom 16 is prevented from being unexpectedly rotated forward by vibration, leak of operating oil or the like.

When the lock is released, in the order opposite to the above mentioned, the front portion of the lock plate 52 is lifted, the hook part 52*a* is disengaged from the lock pin 54, and then the lock plate 52 is slid rearward along the slot 52*c* to the release position.

Next, explanation will be given on another embodiment that the lock device 51 is provided on the boom bracket according to FIGS. 8 to 11.

With regard to the lock device 51, the lock pin 54 as the engaged member is projected sideward (not shown) from the side surface of the boom 16 of the work machine, a lock plate 60 as the engaging member to engage with the lock pin 54 is provided on the boom bracket 15 of the vehicle, and guide members 58 and 59 are disposed in the boom 16 so as to hole the lock plate 60 at a prescribed position and to guide the lock plate 60 at the time of operation.

The lock plate 60, formed in the substantially same shape as the lock plate 52, includes a hook part 60*a*, a forward-slanted surface 60*b* and a slot 60*c*. Since the boom bracket 15 is not tilted forward or backward at the time of work, the lock plate 60 does not comprise any rearward-slanted surface. The lower guide member 58 and upper guide member 59 guide the upper and lower parallel surfaces of the lock plate 60, and are projectively provided integrally on the side surface of the boom bracket 15. A support pin 61 is disposed in the substantial middle of the guide members 58 and 59. The lower guide member 58 is longer than the upper guide member 59 so that the lock plate 60 is held stably by the weight thereof while released, and the lower surface of the lock plate 60 touches the upper rear tip of the lower guide member 58 while locked.

When the lock plate 60 is shifted from the released state to the locked state, the upper guide member 59 touches the upper surface of the lock plate 60, and is slid thereon so as to guide the lock plate 60 stably. The guide member 59 reaches the place above and before the support pin 61 so that the lock plate 60 can be rotated rearward downward after reaching the highest position. A lower end of an operation lever 62 is fixed to the hook part 60*a*, and the grip of the operation lever 62 is extended upward forward toward the operation part so as to make the operation easy.

In the state that the boom 16 is rotated to the foremost position, the lock plate 60 is lifted upwardly rearward by operating the operation lever 62 while being guided by the guide members 58 and 59, and then while the support pin 61 touches the end of the slot 60*c*, the lock plate 60 is rotated downwardly rearward so as to be engaged with the lock pin 54, whereby the lock operation has been performed. Otherwise, when the boom 16 is not positioned at the foremost position and the lock plate 60 is slid upward and rotated rearward by the operation lever 62 so that the upper front portion of the lock plate 60 is separated from the guide member 59, the lock pin 54 touches the forward-slanted surface 60*b* by rotating the boom 16 forward so that the lock plate 60 is slid, lifted and engaged automatically with the hook part 60*a* similarly to the above mentioned, whereby the lock operation has been performed.

With regard to the release operation, opposite to the above mentioned, the lock plate 60 is rotated rearward by operating the operation lever 62 so as to be released from the lock pin 54, and then is pulled rearward so as to be held at the released position.

The support pin 61 supports the lock plate 60 and pivotally supports the tip of the piston rod of the boom cylinder 21. The slip-prevention construction after inserting the support pin 61 to the lock plate 60 is made simple so as to reduce part number and make the assembly easy.

A slip-prevention plate 64 is fixed to the tip of the support pin 61 and the slip-prevention plate 64 is rotated so as to make the prescribed angle which is the same as that of the slot 60*c*, thereby enabled to be inserted into the lock plate 60. After the insertion, the support pin 61 is rotated to the fixed position so as to be prevented from slipping off from the slot 60*c*.

Namely, an oval rotation-prevention plate 63 is fixed to one of ends of the support pin 61 perpendicularly to the axis, and a bolt hole 63*a* is opened at the tip of the rotation-prevention plate 63. Then, a bolt of the like is screwed into a bolt hole 15*e* opened in the boom bracket 15 so as to prevent the support pin 61 from being rotated at the time of work, and to fix the angle of the support pin 61.

A small diameter shaft part 61*a*, whose diameter is in agreement with the shorter diametric width of the slot 60*c* of the lock plate 60, is formed in the other end of the support pin 61 so as to be inserted into the lock plate 60. A slip-prevention plate 64 is fixed to the tip of the support pin 61 perpendicularly. The slip-prevention plate 64 is constructed so that upper and lower sides of a disc larger than the shorter diametric width of the slot 60*c* are shaved so as to form slot surfaces, whereby the disc is formed ovally. The width of the slip-prevention plate 64 in its shorter direction is substantially in agreement with that of the slot 60*c* so that the small diameter shaft part 61*a* of the support pin 61 can be inserted into the lock plate 60 in the state that the slip-prevention plate 64 is disposed parallel to the slot 60*c*.

Figure 8:
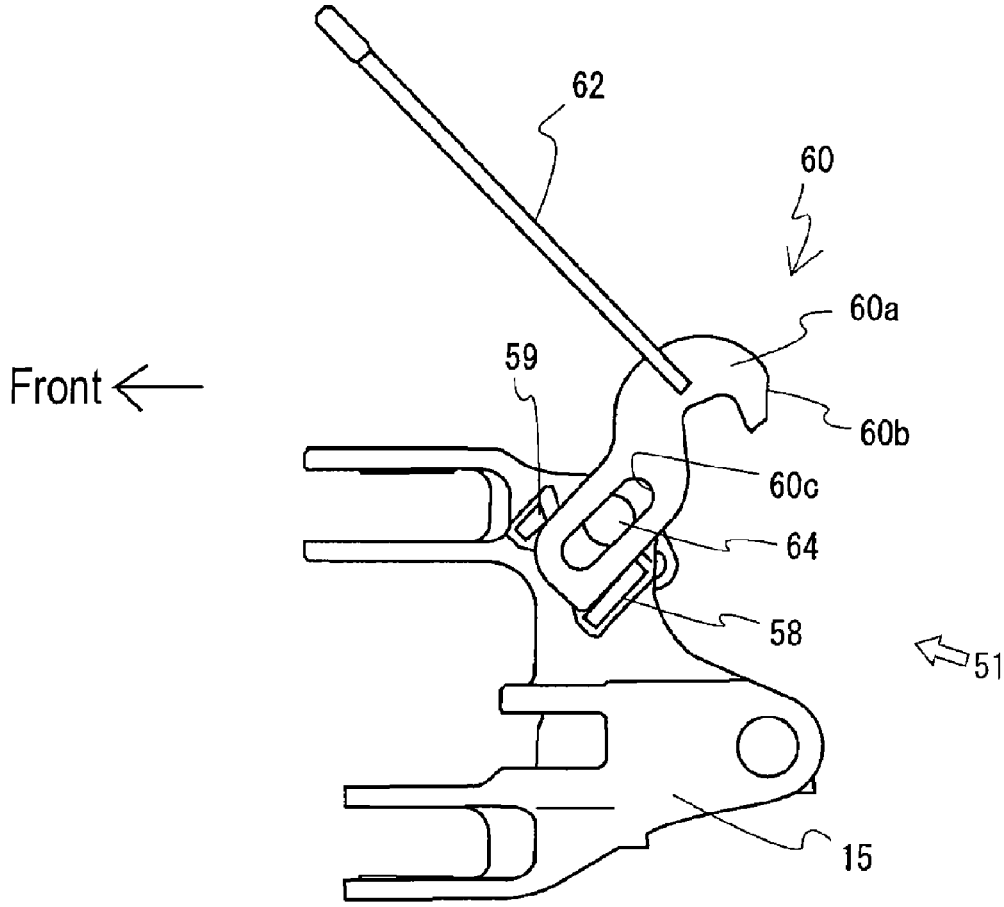
FIG. 8 It is a side view of an embodiment that the lock plate is provided at a side of a boom bracket.
Figure 10:
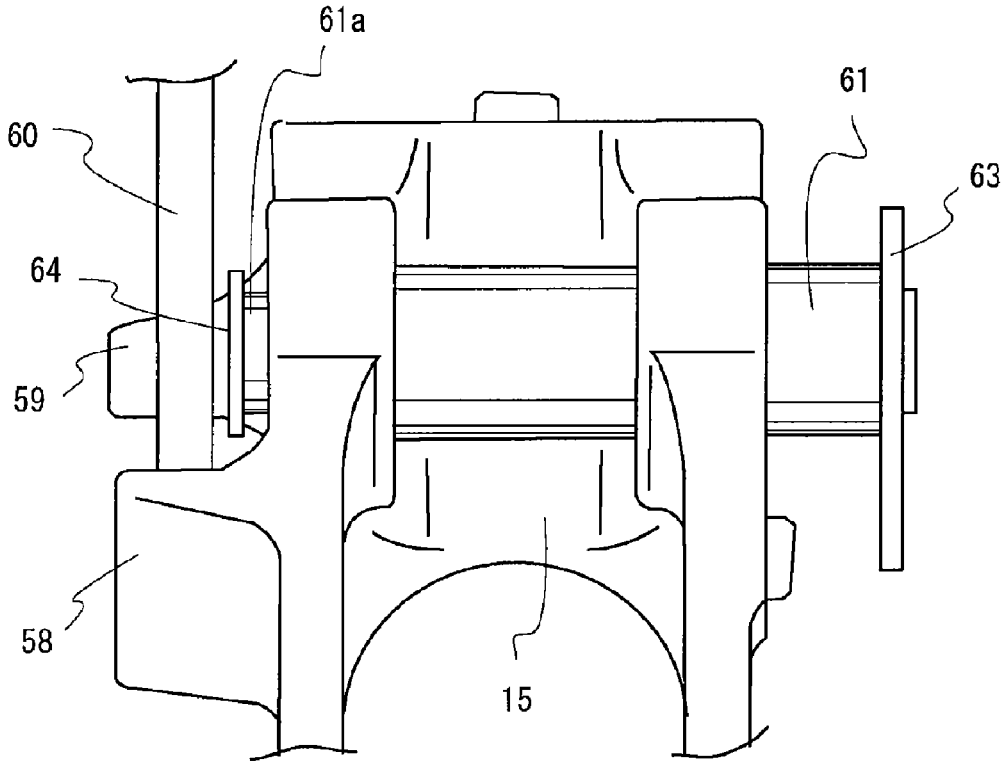
FIG. 10 It is a rear view of the same in the state that a support pin is removed.
Figure 11:
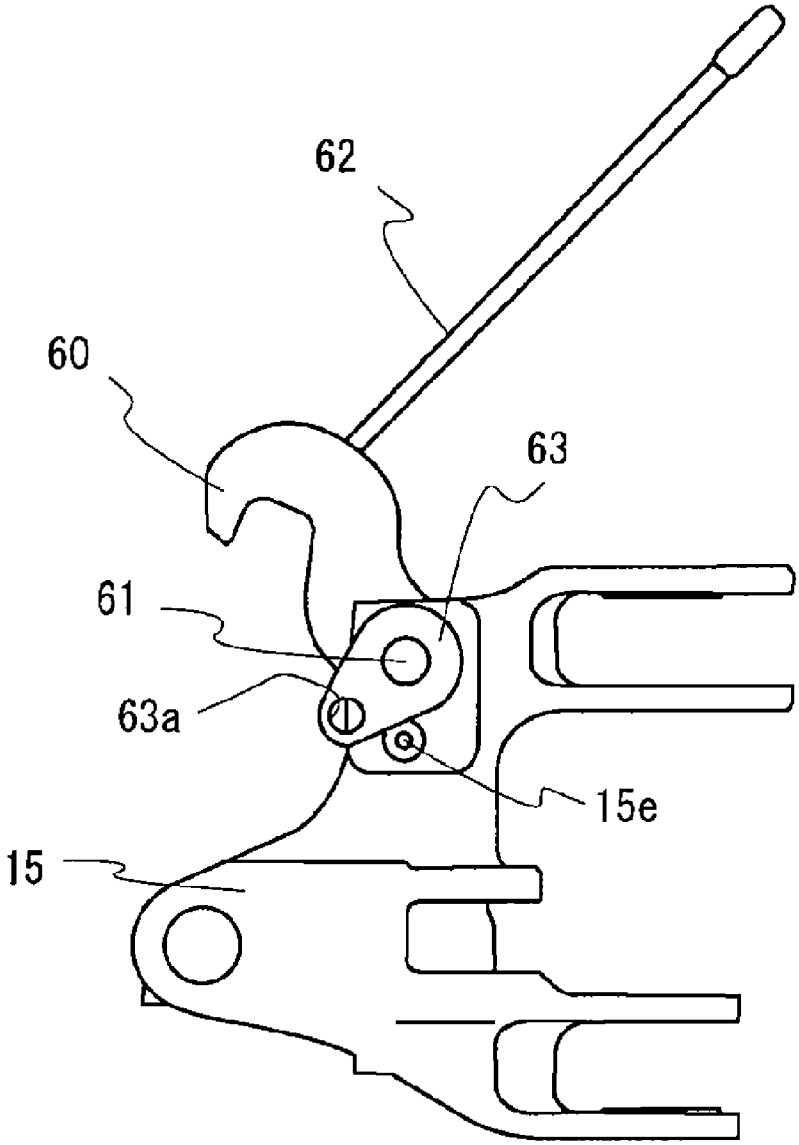
FIG. 11 It is a rear view of the same in the state that the support pin is inserted into the lock plate.

As shown in FIGS. 8, 10 and 11, in the state that the lock plate 60 is arranged between the guide members 58 and 59 and the lengthwise direction of the slot surfaces of the slip-prevention plate 64 of the support pin 61 are parallel to the lengthwise direction of the slot 60*c*, the support pin 61 can be inserted into the lock plate 60. The position of the support pin at which the support pin can be inserted into the lock plate 60 is offset from the bolt hole 63*a* of the rotation-prevention plate 63 and the bolt hole 15*e* of the boom bracket 15.

Figure 9:
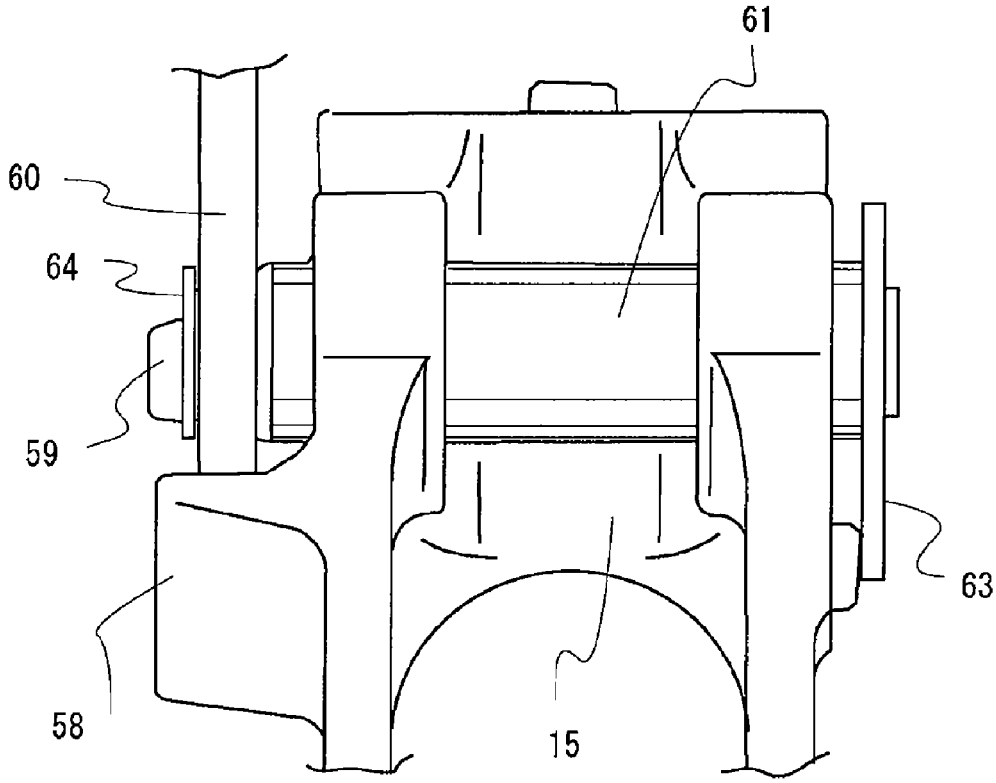
FIG. 9 It is a rear view of the same.
Figure 12:
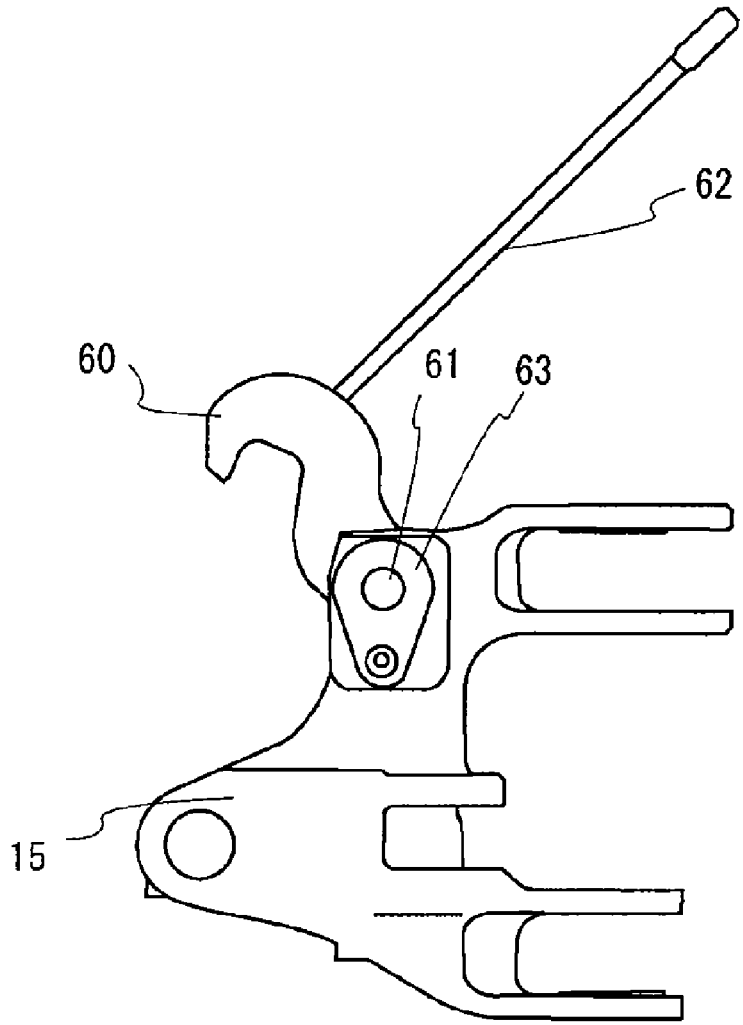
FIG. 12 It is a rear view of the same in the case that the support pin is in slip-prevention state.

In this state, by pushing the support pin 61 as shown in FIG. 9, the small diameter shaft part 61*a* is inserted into the slot 60*c*. After the insertion, as shown in FIG. 12, the slip-prevention plate 64 is rotated so as to make the bolt hole 63*a* in agreement with the bolt hole 15*e* and then a bolt is screwed into the bolt holes, whereby the ends in the lengthwise direction of the slip-prevention plate 64 overlap the part of the plate around the slot 60*c* so that the lock plate 60 cannot be pulled off from the support pin 61. Furthermore, the lock plate 60 is regulated its upper and lower sides by the guide members 58 and 59 and can be slid only in the lengthwise direction of the slot 60*c*. Accordingly, even if the lock plate 60 is slid to any position, the lock plate 60 is prevented from being removed by the slip-prevention plate 64. In addition, the slip-prevention is also adoptable to the construction that the lock plate is attached to the side of the boom.

Accordingly, at the time of assembly of the lock plate 60, the support pin 61 is inserted into the boom bracket 15 and the tip of the piston rod of the boom cylinder 21 and the slot surfaces of the slip-prevention plate 64 is made parallel to the lengthwise direction of the slot 60*c*, and then the support pin 61 is inserted into the lock plate 60. After that, only by rotating the rotation-prevention plate 63, the lock plate 60 is prevented from slipping off, whereby the assembly can be performed easily.

INDUSTRIAL APPLICABILITY

The lock device according to the present invention is adoptable for locking a boom, an arm or the like in the state of stored in a main body, and is available in an excavating device, a loader, a crane and the like.

The invention claimed is:

1. A lock device of a work machine including a main body and an excavating device, the lock device being provided for locking a boom of the excavating device to the main body, the lock device comprising:

an engaging member provided on one of the boom and a boom bracket provided on the main body, wherein the engaging member is constituted by a plate formed on one side thereof with a hook part, and on the other side thereof with a slot, and wherein the engaging member is provided on the other side thereof with first and second surfaces so that the first surface is parallel to the slot, and the second surface is slanted from the slot;

an engaged member provided on the other of the boom and the boom bracket;

a support pin inserted into the slot; and a guide member is disposed above the support pin, so that the support pin and the guide member support the engaging member, wherein when the engaged member is released from the hook part, either the first surface or the second surface can touch the guide member, and wherein when the engaged member is engaged with the hook part, the second surface touches the guide member.

2. The lock device of a work machine as set forth in claim 1, wherein the guide member is provided on the boom, and does not become horizontal while the boom is rotated between its highest position and its lowest position.

3. The lock device of a work machine as set forth in claim 1, wherein an end surface of the one side of the engaging member at which the hook part is positioned is enabled to touch the engaged member and is slanted toward a lengthwise center of the engaging member.

4. The lock device of a work machine as set forth in claim 1, wherein a slip-prevention plate is fixed to a tip of the support pin and the support pin can be inserted into the slot through the slip-prevention plate at a prescribed angle.

5. The lock device of a work machine as set forth in claim 1, wherein a member supporting the engaging member is projected from the boom bracket and the guide member is formed integrally with the boom bracket.

6. The lock device of a work machine as set forth in claim 5, wherein the guide member is arranged at upper and lower sides of the engaging member so as to touch slidingly upper and lower surfaces of the other side of the engaging member.

* * * * *